US005389199A

United States Patent [19]

Awad et al.

[11] Patent Number: 5,389,199

[45] Date of Patent: Feb. 14, 1995

[54] AQUEOUS LUBRICANT AND SURFACE CONDITIONER FOR FORMED METAL SURFACES

[75] Inventors: Sami B. Awad, Drexel Hill, Pa.; Timm L. Kelly, Birmingham; Gary L. Rochfort, Troy, both of Mich.

[73] Assignee: Henkel Corporation, Plymouth Meeting, Pa.

[21] Appl. No.: 126,143

[22] Filed: Sep. 23, 1993

Related U.S. Application Data

[60] Division of Ser. No. 910,483, Jul. 8, 1992, abandoned, which is a continuation-in-part of Ser. No. 785,635, Oct. 31, 1991, abandoned, which is a continuation of Ser. No. 521,219, May 8, 1990, Pat. No. 5,080,814, which is a continuation of Ser. No. 395,620, Aug. 18, 1989, Pat. No. 4,944,889, which is a continuation-in-part of Ser. No. 57,129, Jun. 1, 1987, Pat. No. 4,859,351.

[51] Int. Cl.[6] ..... C23F 1/00; B44C 1/22

[52] U.S. Cl. ..... 156/665; 252/493; 252/41; 252/49.8; 252/51.5 A/56 R

[58] Field of Search ..... 252/49.3, 41, 49.8, 252/55.5 A, 56; 156/665

[56] References Cited

U.S. PATENT DOCUMENTS

| | | | |
|---|---|---|---|
| 4,944,889 | 7/1990 | Awad | 156/665 |
| 5,030,323 | 7/1991 | Awad | 156/665 |
| 5,080,814 | 1/1992 | Awad | 252/49.3 |

*Primary Examiner*—Sam Silverberg

*Attorney, Agent, or Firm*—Ernest G. Szoke; Wayne C. Jaeschke; Norvell E. Wisdom, Jr.

[57] ABSTRACT

A lubricant and surface conditioner for formed metal surfaces, particularly beverage containers, reduces the coefficient of static friction of said metal surfaces and enables drying said metal surfaces at a lower temperature. The conditioner includes a water-soluble organic material selected from a phosphate ester, alcohol, fatty acid including mono-, di-, tri-, and polyacids; fatty acid derivatives such as salts, hydroxy acids, amides, esters, ethers and derivatives thereof; and mixtures thereof.

17 Claims, No Drawings

AQUEOUS LUBRICANT AND SURFACE CONDITIONER FOR FORMED METAL SURFACES

CROSS-REFERENCE TO RELATED APPLICATIONS

This application is a division of application Ser. No. 07/910,483, filed Jul. 8, 1992, now abandoned which was a continuation-in-part of application Ser. No. 785,635, filed Oct. 31, 1991, and now abandoned which was a continuation of application Ser. No. 521,219, filed May 8, 1990, now U.S. Pat. No. 5,080,814, which was a continuation of application Ser. No. 395,620, filed Aug. 18, 1989, now U.S. Pat. No. 4,944,889, which was a continuation-in-part of Ser. No. 07/057,129, filed Jun. 1, 1987, now U.S. Pat. No. 4,859,351. The entire disclosures of all the aforementioned patents, to the extent not inconsistent with any explicit statement herein, are hereby incorporated herein by reference.

BACKGROUND OF THE INVENTION

1. Field of the Invention

This invention relates to a lubricant and surface conditioner for formed metal surfaces, and more particularly, to such a lubricant and surface conditioner which improves the mobility of aluminum cans without adversely affecting the adhesion of paints or lacquers applied thereto, and also enables lowering the dryoff oven temperature required for drying said surfaces.

2. Discussion of Related Art

Aluminum cans are commonly used as containers for a wide variety of products. After their manufacture, the aluminum cans are typically washed with acidic cleaners to remove aluminum fines and other contaminants therefrom. Recently, environmental considerations and the possibility that residues remaining on the cans following acidic cleaning could influence the flavor of beverages packaged in the cans has led to an interest in alkaline cleaning to remove such fines and contaminants. However, the treatment of aluminum cans generally results in differential rates of metal surface etch on the outside versus on the inside of the cans. For example, optimum conditions required to attain an aluminum fine-free surface on the inside of the cans usually leads to can mobility problems on conveyors because of the increased roughness on the outside can surface.

These aluminum can mobility problems are particularly apparent when it is attempted to convey the cans through single filers and to printers. Thus, a need has arisen in the aluminum can manufacturing industry to modify the coefficient of static friction on the outside and inside surfaces of the cans to improve their mobility without adversely affecting the adhesion of paints or lacquers applied thereto. The reason for improving the mobility of aluminum cans is the general trend in this manufacturing industry to increase production without additional capital investments in building new plants. The increased production demand is requiring can manufacturers to increase their line and printer speeds to produce 20 to 40 percent more cans per unit of time. For example, the maximum speed at which aluminum cans, in the absence of any treatment to reduce their coefficient of surface friction, may be passed through a printing station typically is on the average of about 1150 cans per minute, whereas it is desired that such rate be increased to about 1400 to 1500 cans per minute or even higher.

However, aluminum cans thoroughly cleaned by either acid or alkaline cleaner are, in general, characterized by high surface roughness and thus have a high coefficient of static friction. This property hinders the flow of cans through single filers and printers when attempting to increase their line speed. As a result, printer misfeeding problems, frequent jammings, down time, and loss of production occur in addition to high rates of can spoilage.

Another consideration in modifying the surface properties of aluminum cans is the concern that such modification may interfere with or adversely affect the ability of the can to be printed when passed to a printing or labeling station. For example, after cleaning the cans, labels may be printed on their outside surface, and lacquers may be sprayed on their inside surface. In such a case, the adhesion of the paints and lacquers is of major concern.

In addition, the current trend in the can manufacturing industry is directed toward using thinner gauges of aluminum metal stock. The down-gauging of aluminum can metal stock has caused a production problem in that, after washing, the cans require a lower drying oven temperature in order to pass the column strength pressure quality control test. However, lowering the drying oven temperature resulted in the cans not being dry enough when they reached the printing station, and caused label ink smears and a higher rate of can rejects.

Thus, it would be desirable to provide a means of improving the mobility of aluminum cans through single filers and printers to increase production, reduce line jammings, minimize down time, reduce can spoilage, improve ink laydown, and enable lowering the drying oven temperature of washed cans. Accordingly, it is an object of this invention to provide such means of improving the mobility of aluminum cans and to overcome the afore-noted problems.

DESCRIPTION OF THE INVENTION

Other than in the operating examples, or where otherwise indicated, all numbers expressing quantities of ingredients or reaction conditions used herein are to be understood as modified in all instances by the term "about" in describing the broadest scope of the invention. Practice within the exact numerical limits given, however, is generally preferred.

In accordance with this invention, it has been found that a lubricant and surface conditioner applied to aluminum cans after washing enhances their mobility and, in a preferred embodiment, improves their water film drainage and evaporation characteristics as to enable lowering the temperature of a drying oven by from about 25° to about 100° F. without having any adverse effect on the label printing process. The lubricant and surface conditioner reduces the coefficient of static friction on the outside surface of the cans, enabling a substantial increase in production line speeds, and in addition, provides a noticeable improvement in the rate of water film drainage and evaporation resulting in savings due to lower energy demands while meeting quality control requirements.

More particularly, in accordance with one preferred embodiment of this invention, it has been found that application of a thin organic film to the outside surface of aluminum cans serves as a lubricant inducing thereto a lower coefficient of static friction, which consequently provides an improved mobility to the cans, and also increases the rate at which the cans may be dried and still pass the quality control column strength pressure test. It has also been found that the degree of improved mobility and drying rate of the cans depends on the thickness or amount of the organic film, and on the chemical nature of the material applied to the cans.

The lubricant and surface conditioner for aluminum cans in accordance with this invention may, for example, be selected from water-soluble alkoxylated surfactants such as organic phosphate esters; alcohols; fatty acids including mono-, di-, tri-, and poly-acids; fatty acid derivatives such as salts, hydroxy acids, amides, esters, ethers and derivatives thereof; and mixtures thereof.

The lubricant and surface conditioner for aluminum cans in accordance with this invention in one embodiment preferably comprises a water-soluble derivative of a saturated fatty acid such as an ethoxylated stearic acid or an ethoxylated isostearic acid, or alkali metal salts thereof such as polyoxyethylated stearate and polyoxyethylated isostearate. Alternatively, the lubricant and surface conditioner for aluminum cans may comprise a water-soluble alcohol having at least about 4 carbon atoms and may contain up to about 50 moles of ethylene oxide. Excellent results have been obtained when the alcohol comprises polyoxyethylated oleyl alcohol containing an average of about 20 moles of ethylene oxide per mole of alcohol.

In another preferred aspect of this invention, the organic material employed to form a film on an aluminum can following alkaline or acid cleaning and prior to the last drying of the exterior surface prior to conveying comprises a water-soluble organic material selected from a phosphate ester, an alcohol, fatty acids including mono-, di-, tri-, and poly-acids fatty acid derivates including salts, hydroxy acids, amides, alcohols, esters, ethers and derivatives thereof and mixtures thereof. Such organic material is preferably part of an aqueous solution comprising water-soluble organic material suitable for forming a film on the cleaned aluminum can to provide the surface after drying with a coefficient of static friction not more than 1.5 and that is less than would be obtained on a can surface of the same type without such film coating.

In one embodiment of the invention, water solubility can be imparted to organic materials by alkoxylation, preferably ethoxylation, propoxylation or mixture thereof. However, non-alkoxylated phosphate esters are also useful in the present invention, especially free acid containing or neutralized mono-and diesters of phosphoric acid with various alcohols. Specific examples include Tryfac® 5573 Phosphate Ester, a free acid containing ester available from Henkel Corp.; and Triton®H-55, Triton® H-66, and Triton® QS-44, all available from Rhone-Poulenc.

Preferred non-ethoxylated alcohols include the following classes of alcohols:

Suitable monohydric alcohols and their esters with inorganic acids include water soluble compounds containing from 3 to about 20 carbons per molecule. Specific examples include sodium lauryl sulfates such as Duponol® WAQ and Duponol® QC and Duponol® WA and Duponol® C available from Witco Corp. and proprietary sodium alkyl sulfonates such as Alkanol®189-S available from E.I. du Pont de Nemours & Co.

Suitable polyhydric alcohols include aliphatic or arylalkyl polyhydric alcohols containing two or more hydroxyl groups. Specific examples include glycerine, sorbitol, mannitol, xanthan gum, hexylene glycol, gluconic acid, gluconate salts, glucoheptonate salts, pentaerythritol and derivatives thereof, sugars, and alkylpolyglycosides such as APG®300 and APG®325, available from Henkel Corp. Especially preferred polyhydric alcohols include triglycerols, especially glycerine or fatty acid esters thereof such as castor oil triglycerides.

In accordance with the present invention, we have discovered that employing alkoxylated, especially ethoxylated, castor oil triglycerides as lubricants and surface conditioners results in further improvements in can mobility especially where operation of the can line is interrupted causing the cans to be exposed to elevated temperatures for extended periods. Accordingly, especially preferred materials include Trylox® 5900, Trylox® 5902, Trylox® 5904, Trylox® 5906, Trylox® 5907, Trylox® 5909, Trylox® 5918, and hydrogenated castor oil derivatives such as Trylox® 5921 and Trylox® 5922, all available from Henkel Corp.

Preferred fatty acids include butyric, valeric, caproic, caprylic, capric, pelargonic, lauric, myristic, palmitic, oleic, stearic, linoleic, and ricinoleic acids; malonic, succinic, glutaric, adipic, maleic, tartaric, gluconic, and dimer acids; and salts of any of these; iminodipropionate salts such as Amphoteric N and Amphoteric 400 available from Exxon Chemical Co.; sulfosuccinate derivatives such as Texapon®SH-135 Special and Texapon®SB-3, available from Henkel Corp.; citric, nitrilotriacetic, and trimellitic acids; Cheelox® HEEDTA, N-(hydroxyethyl)ethylenediaminetriacetate, available from GAF Chemicals Corp.

Preferred amides generally include amides or substituted amides of carboxylic acids having from four to twenty carbons. Specific examples are Alkamide® L203 lauric monoethanolamide, Alkamide® L7DE lauric/myristic alkanolamide, Alkamide® DS 280/s stearic diethanolamide, Alkamide® CD coconut diethanolamide, Alkamide® DIN 100 lauric/linoleic diethanolamide, Alkamide® DIN 295/s linoleic diethanolamide, Alkamide® DL 203 lauric diethanolamide, all available from Rhone-Poulenc; Monamid® 150-MW myristic ethanolamide, Monamid® 150-CW capric ethanolamide, Monamid® 150-IS isostearic ethanolamide, all available from Mona Industries 15 Inc.; and Ethomid® HT/23 and Ethomid® HT60 polyoxyethylated hydrogenated tallow amines, available from Akzo Chemicals Inc.

Preferred anionic organic derivatives generally include sulfate and sulfonate derivates of fatty acids including sulfate and sulfonate derivatives of natural and synthetically derived alcohols, acids and natural products. Specific Examples: dodecyl benzene sulfonates such as Dowfax® 2A1, Dowfax® 2AO, Dowfax® 3BO, and Dowfax® 3B2, all available from Dow Chemical Co.; Lomar® LS condensed naphthalene sulfonic acid, potassium salt available from Henkel Corp.; sulfosuccinate derivatives such as Monamate® CPA sodium sulfosuccinate of a modified alkanolamide, Monamate® LA-100 disodium lauryl sulfosuccinate, all available from Mona Industries; Triton® GR-5M sodium dioctylsulfosuccinate, available from Union Carbide Chemical and Plastics Co.; Varsulf® SBFA 30, fatty alcohol ether sulfosuccinate, Varsulf® SBL 203, fatty acid alkanolamide sulfosuccinate, Varsulf®

S1333, ricinoleic monoethanolamide sulfosuccinate, all available from Sherex Chemical Co., Inc.

Another preferred group of organic materials comprise water-soluble alkoxylated, preferably ethoxylated, propoxylated, or mixed ethoxylated and propoxylated materials, most preferably ethoxylated, and non-ethoxylated organic materials selected from amine salts of fatty acids including mono-, di-, tri-, and poly-acids, amino fatty acids, fatty amine N-oxides, and quaternary salts, and water soluble polymers.

Preferred amine salts of fatty acids include ammonium, quaternary ammonium, phosphonium, and alkali metal salts of fatty acids and derivatives thereof containing up to 50 moles of alkylene oxide in either or both the cationic or anionic species. Specific examples include Amphoteric N and Amphoteric 400 iminodipropionate sodium salts, available from Exxon Chemical Co.; Deriphat® 154 disodium N-tallow-beta iminodipropionate and Deriphat® 160, disodium N-lauryl-beta iminodipropionate, available from Henkel Corp.

Preferred amino acids include alpha and beta amino acids and diacids and salts thereof, including alkyl and alkoxyiminodipropionic acids and their salts and sarcosine derivatives and their salts. Specific examples include Armeen® Z, N-coco-beta-aminobutyric acid, available from Akzo Chemicals Inc.; Amphoteric N, Amphoteric 400, Exxon Chemical Co.; sarcosine (N-methyl glycine); hydroxyethyl glycine; Hamposyl® TL-40 triethanolamine lauroyl sarcosinate, Hamposyl® 0 oleyl sarcosinate, Hamposyl® AL-30 ammoniumlauroyl sarcosinate, Hamposyl® L lauroyl sarcosinate, and Hamposyl® C cocoyl sarcosinate, all available from W.R. Grace & Co.

Preferred amine N-oxides include amine oxides where at least one alkyl substituent contains at least three carbons and up to 20 carbons. Specific examples include Aromox® C/12 bis-(2-hydroxyethyl)cocoalkylamine oxide, Aromox® T/12 bis-(2-hydroxyethyl)-tallowalkylamine oxide, Aromox® DMC dimethylcocoalkylamine oxide, Aromox® DMHT hydrogenated dimethyltallowalkylamine oxide, Aromox® DM-16 dimethylheaxdecylalkylamine oxide, all available from Akzo Chemicals Inc.; and Tomah® AO-14-2 and Tomah® AO-728 available from Exxon Chemical Co.

Preferred quaternary salts include quaternary ammonium derivatives of fatty amines containing at least one substituent containing from 12 to 20 carbon atoms and zero to 50 moles of ethylene oxide and/or zero to 15 moles of propylene oxide where the counter ion consists of halide, sulfate, nitrate, carboxylate, alkyl or aryl sulfate, alkyl or aryl sulfonate or derivatives thereof. Specific examples include Arquad® 12-37W dodecyltrimethylammonium chloride, Arquad® 18-50 octadecyltrimethylammonium chloride, Arquad® 210-50 didecyldimethylammonium chloride, Arquad® 218-100 dioctadecyldimethylammonium chloride, Arquad® 316(W) trihexadecylmethylammonium chloride, Arquad® B-100 benzyldimethyl($C_{12-18}$)alkylammonium chloride, Ethoquad® C/12 cocomethyl[POE(2)]ammonium chloride, Ethoquad® C/25 cocomethyl[POE(15)]ammonium chloride, Ethoquad® C/12 nitrate salt, Ethoquad® T/13 Acetate tris(2-hydroxyethyl)tallowalkyl ammonium acetate, Duoqaud® T-50 N,N,N',N',N'-pentamethyl-N-tallow-1,3-diammonium dichloride, Propoquad® 2HT/11 di(hydrogenated tallowalkyl)(2-hydroxy-2-methylethyl)methylammonium chloride, Propoquad®T/12 tallowalkylmethyl-bis-(2-hydroxy-2-methylethyl)ammonium methyl sulfate, all available from Akzo Chemicals Inc.; Monaquat® P-TS stearamidopropyl PG-dimonium chloride phosphate, available from Mona Industries Inc.; Chemquat® 12-33 lauryltrimethylammonium chloride, Chemquat® 16-50 Cetyltrimethylammonium chloride available from Chemax Inc.; and tetraethylammonium pelargonate, laurate, myristate, oleate, stearate or isostearate.

Preferred water-soluble polymers include homopolymers and heteropolymers of ethylene oxide, propylene oxide, butylene oxide, acrylic acid and its derivatives, maleic acid and its derivatives, vinyl phenol and its derivatives, and vinyl alcohol. Specific examples include Carbowax® 200, Carbowax® 600, Carbowax® 900, Carbowax® 1450, Carbowax® 3350, Carbowax® 8000, and Compound 20M, all available from Union Carbide Corp.; Pluronic® L61, Pluronic® LB1, Pluronic® 31R1, Pluronic® 25R2, Tetronic® 304, Tetronic® 701, Tetronic® 908, Tetronic® 90R4, and Tetronic® 150R1, all available from BASF Wyandotte Corp.; Acusol® 410N sodium salt of polyacrylic acid, Acusol® 445 polyacrylic acid, Acusol® 460ND sodium salt of maleic acid/olefin copolymer, and Acusol® 479N sodium salt of acrylic acid/maleic acid copolymer, all available from Rohm & Haas Company; and N-methylglucamine adducts of polyvinylphenol and N-methylethanolamine adducts of polyvinylphenol.

Additional improvements are achieved by combining in the process of this invention the step of additionally contacting the exterior of an aluminum can with an inorganic material selected from metallic or ionic zirconium, titanium, cerium, aluminum, iron, vanadium, tantalum, niobium, molybdenum, tungsten, hafnium or tin to produce a film combining one or more of these metals with one or more of the above-described organic materials. A thin film is produced having a coefficient of static friction that is not more than 1.5 and is less than the coefficient without such film, thereby improving can mobility in high speed conveying without interfering with subsequent lacquering, other painting, printing, or other similar decorating of the containers.

The technique of incorporating such inorganic materials is described, in particular detail with reference to zirconium containing materials, in U.S. Pat. Nos. 5,030,323 of Jul. 9, 1991 and 5,064,500 of Nov. 12, 1991, the entire disclosures of which, to the extent not inconsistent with any explicit statement herein, are hereby incorporated herein by reference. The substitution of other metallic materials for those taught explicitly in one of these patents is within the scope of those skilled in the art.

In a further preferred embodiment of the process of the present invention, in order to provide improved water solubility, especially for the non-ethoxylated organic materials described herein, and to produce a suitable film on the can surface having a coefficient of static friction not more than 1.5 after drying, one employs a mixture of one or more surfactants, preferably alkoxylated and most preferably ethoxylated, along with such non-ethoxylated organic material to contact the cleaned can surface prior to final drying and conveying. Preferred surfactants include ethoxylated and non-ethoxylated sulfated or sulfonated fatty alcohols, such as lauryl and coco alcohols. Suitable are a wide class of anionic, non-ionic, cationic, or amphoteric surfactants. Alkyl polyglycosides such as $C_8$-$C_{18}$ alkyl polyglycosides having average degrees of polymerization between 1.2 and 2.0 are also suitable. Other classes of surfactants suitable in combination are ethoxylated nonyl and octyl phenols containing from 1.5 to 100 moles of ethylene oxide, preferably a nonylphenol condensed with from 6 to 50 moles of ethylene oxide such as Igepal® CO-887 available from Rhone-Poulenc; alkyl/aryl polyethers, for example, Triton® DF-16; and phosphate esters of which Triton® H-66 and Triton® QS-44 are examples, all of the Triton® products being available from Union Carbide Co., and Ethox® 2684 and Ethfac® 136, both available from Ethox Chemicals Inc., are representative examples; polyethoxylated and/or polypropoxylated derivatives of linear and branched alcohols and derivatives thereof, as for example Trycol® 6720 (Henkel Corp.), Surfonic® LF-17 (Texaco) and Antarox® LF-330 (Rhone-Poulenc); sulfonated derivatives of linear or branched aliphatic alcohols, for example, Neodol® 25-3S (Shell Chemical Co.); sulfonated aryl derivatives, for example, Dyasulf® 9268-A, Dyasulf® C-70, Lomar® D (all available from Henkel Corp.) and Dowfax® 2A1 (available from Dow Chemical Co.); and ethylene oxide and propylene oxide copolymers, for example, Pluronic® L-61, Pluronic® 81, Pluronic® 31R1, Tetronic® 701, Tetronic® 90R4 and Tetronic® 150R1, all available from BASF Corp.

Further, the lubricant and surface conditioner for aluminum cans in accordance with this invention may comprise a phosphate acid ester or preferably an ethoxylated alkyl alcohol phosphate ester. Such phosphate esters are commercially available under the tradename Gafac® PE 510 from GAF Corporation, Wayne, N.J., and as Ethfac® 136 and Ethfac® 161 from Ethox Chemicals, Inc., Greenville, S.C. In general, the organic phosphate esters may comprise alkyl and aryl phosphate esters with and without ethoxylation.

The lubricant and surface conditioner for aluminum cans may be applied to the cans during their wash cycle, during one of their treatment cycles such as cleaning or conversion coating, during one of their water rinse cycles, or more preferably, during their final water rinse cycle. In addition, the lubricant and surface conditioner may be applied to the cans after their final water rinse cycle, i.e., prior to oven drying, or after oven drying, by fine mist application from water or another volatile non-inflammable solvent solution. It has been found that the lubricant and surface conditioner is capable of depositing on the aluminum surface of the cans to provide them with the desired characteristics. The lubricant and surface conditioner may be applied by spraying and reacts with the aluminum surface through chemisorption or physiosorption to provide it with the desired film.

Generally, in the cleaning process of the cans, after the cans have been washed, they are typically exposed to an acidic water rinse. In accordance with this invention, the cans may thereafter be treated with a lubricant and surface conditioner comprising an anionic surfactant such as a phosphate acid ester. In such case, the pH of the treatment system is important and generally should be acidic, that is between about 1 and about 6.5, preferably between about 2.5 and about 5. If the cans are not treated with the lubricant and surface conditioner of this invention next after the acidic water rinse, the cans are often exposed to a tap water rinse and then to a deionized water rinse. In such event, the deionized water rinse solution is prepared to contain the lubricant and surface conditioner of this invention, which may comprise a nonionic surfactant selected from the aforementioned polyoxyethylated alcohols or polyoxyethylated fatty acids, or any of the other suitable materials as described above. After such treatment, the cans may be passed to an oven for drying prior to further processing.

The amount of lubricant and surface conditioner to be applied to the cans should be sufficient to reduce the coefficient of static friction on the outside surface of the cans to a value of about 1.5 or lower, and preferably to a value of about 1 or lower. Generally speaking, such amount should be on the order of from about 3 $mg/m^2$ to about 60 $mg/m^2$ of lubricant and surface conditioner on the outside surface of the cans.

For a fuller appreciation of the invention, reference should be made to the following examples, which are intended to be merely descriptive, illustrative, and not limiting as to the scope of the invention.

EXAMPLE I

This example illustrates the amount of aluminum can lubricant and surface conditioner necessary to improve the mobility of the cans through the tracks and printing stations of an industrial can manufacturing facility, and also shows that the lubricant and surface conditioner does not have an adverse effect on the adhesion of labels printed on the outside surface as well as of lacquers sprayed on the inside surface of the cans.

Uncleaned aluminum cans obtained from an industrial can manufacturer were washed clean with an alkaline cleaner available from the Parker+Amchem Division, Henkel Corporation, Madison Heights, Mich., employing that company's Ridoline® 3060/306 process. The cans were washed in a laboratory Miniwasher processing 14 cans at a time. The cans were treated with different amounts of lubricant and surface conditioner in the final rinse stage of the washer and then dried in an oven. The lubricant and surface conditioner comprised about a 10% active concentrate of polyoxyethylated isostearate, an ethoxylated nonionic surfactant, available under the tradename Ethox™ MI-14 from Ethox Chemicals, Inc., Greenville, S.C. The treated cans were returned to the can manufacturer for line speed and printing quality evaluations. The printed cans were divided into two groups, each consisting of 4 to 6 cans. All were subjected for 20 minutes to one of the following adhesion test solutions:

Test Solution A: 1% Joy® (a commercial liquid dishwashing detergent, Procter and Gamble Co.) solution in 3:1 deionized water:tap water at a temperature of 180° F.

Test Solution B: 1% Joy® detergent solution in deionized water at a temperature of 212° F.

After removing the printed cans from the adhesion test solution, each can was cross-hatched using a sharp metal object to expose lines of aluminum which showed through the paint or lacquer, and tested for paint adhesion. This test included applying Scotch® transparent tape No. 610 firmly over the cross-hatched area and then drawing the tape back against itself with a rapid pulling motion such that the tape was pulled away from the cross-hatched area. The results of the test were rated as follows: 10, perfect, when the tape did not peel any paint from the surface; 8, acceptable; and 0. total failure. The cans were visually examined for any print or lacquer pick-off signs.

In addition, the cans were evaluated for their coefficient of static friction using a laboratory static friction tester. This device measures the static friction associated with the surface characteristics of aluminum cans. This is done by using a ramp which is raised through an arc of 90° by using a constant speed motor, a spool and a cable attached to the free swinging end of the ramp. A cradle attached to the bottom of the ramp is used to hold 2 cans in horizontal position approximately 0.5 inches apart with the domes facing the fixed end of the ramp. A third can is laid upon the 2 cans with the dome facing the free swinging end of the ramp, and the edges of all 3 cans are aligned so that they are even with each other.

As the ramp begins to move through its arc, a timer is automatically actuated. When the ramp reaches the angle at which the third can slides freely from the 2 lower cans, a photoelectric switch shuts off the timer. It is this time, recorded in seconds, which is commonly referred to as "slip time". The coefficient of static friction is equal to the tangent of the angle swept by the ramp at the time the can begins to move.

The average values for the adhesion test and coefficient of static friction evaluation results are summarized in Table 1 which follows:

TABLE 1

| Test No. | Lubricant and Surface Conditioner Concentrate (%/vol.) | Adhesion Evaluation | | | | Coefficient of Static Friction |
|---|---|---|---|---|---|---|
| | | Test Solution | OSW | ISW | ID | |
| 1 | Control (no treatment) | — | — | — | — | 1.42 |
| 2 | 0.1 | B | 10 | 10 | 10 | 0.94 |
| 3 | 0.25 | A | 10 | 10 | 10 | — |
| 4 | 0.5 | B | 9.5* | 10 | 10 | 0.80 |
| 5 | 0.75 | A | 10 | 10 | 10 | 0.63 |
| 6 | 1.0 | B | 10 | 10 | 10 | 0.64 |
| 7 | 2.0 | A | 10 | 10 | 10 | 0.56 |
| 8 | 5.0 | B | 10 | 10 | 10 | 0.55 |
| 9 | 10.0 | A | 9.8* | 10 | 10 | 0.56 |

*Little pick-off was visually noticed on the outside walls, mainly at the contact marks.

In Table 1, OSW stands for outside sidewall, ISW stands for inside sidewall, and ID stands for inside dome.

In brief, it was found that the lubricant and surface conditioner concentrate as applied to the cleaned aluminum cans provided improved mobility to the cans even at very low use concentrations, and it had no adverse effect on either adhesion of label print or internal lacquer tested even at 20 to 100 times the required use concentration to reduce the coefficient of static friction of the cans.

EXAMPLE II

This example illustrates the use of the aluminum can lubricant and surface conditioner of Example I in an industrial can manufacturing facility when passing cans through a printing station at the rate of 1260 cans per minute.

Aluminum can production was washed with an acidic cleaner (Ridoline ® 125 CO, available from the Parker+Amchem Division, Henkel Corporation, Madison Heights, Mich.), and then treated with a non-chromate conversion coating (Alodine ® 404, also available from the Parker+Amchem Division, Henkel Corporation, Madison Heights, Mich.). The aluminum can production was then tested for "slip" and the exterior of the cans were found to have a static coefficient of friction of about 1.63. During processing of these cans through a printer station, the cans could be run through the printer station at the rate of 1150 to 1200 cans per minute without excessive "trips", i.e., improperly loaded can events. In such case, the cans are not properly loaded on the mandrel where they are printed. Each "trip" causes a loss of cans which have to be discarded because they are not acceptable for final stage processing.

About 1 ml/liter of aluminum can lubricant and surface conditioner was added to the deionized rinse water system of the can washer, which provided a reduction of the static coefficient of friction on the exterior of the cans to a value of 1.46 or a reduction of about 11 percent from their original value. After passing the cans through the printer, it was found that the adhesion of both the interior and exterior coatings were unaffected by the lubricant and surface conditioner. In addition, the printer speed could be increased to its mechanical limit of 1250 to 1260 cans per minute without new problems.

In similar fashion, by increasing the concentration of the aluminum can lubricant and the surface conditioner to the deionized rinse water system, it was possible to reduce the coefficient of static friction of the cans by 20 percent without adversely affecting the adhesion of the interior and exterior coatings of the cans. Further, it was possible to maintain the printer speed continuously at 1250 cans per minute for a 24-hour test period.

EXAMPLE III

This example illustrates the use of other materials as the basic component for the aluminum can lubricant and surface conditioner.

Aluminum cans were cleaned with an alkaline cleaner solution having a pH of about 12 at about 105° F. for about 35 seconds. The cans were rinsed, and then treated with three different lubricant and surface conditioners comprising various phosphate ester solutions. Phosphate ester solution 1 comprised a phosphate acid ester (available under the tradename Gafac ® PE 510 from GAF Corporation, Wayne, N.J.) at a concentration of 0.5 g/l. Phosphate ester solution 2 comprised an ethoxylated alkyl alcohol phosphate ester (available under the tradename Ethfac ® 161 from Ethox Chemicals, Inc., Greenville, S.C.) at a concentration of 0.5 g/l. Phosphate ester solution 3 comprised an ethoxylated alkyl alcohol phosphate ester (available under the tradename Ethfac ® 136 from Ethox Chemicals, Inc., Greenville, S.C.) at a concentration of 1.5 g/l.

The mobility of the cans in terms of coefficient of static friction was evaluated and found to be as follows:

| Phosphate ester solution | pH | Coefficient of static friction |
|---|---|---|
| 1 | 3.6 | 0.47 |
| 2 | 3.3 | 0.63 |
| 3 | 2.6 | 0.77 |
| None | — | 1.63 |

The aforementioned phosphate ester solutions all provided an acceptable mobility to aluminum cans, but the cans were completely covered with "water-break". It is desired that the cans be free of water-breaks, i.e., have a thin, continuous film of water thereon, because otherwise they contain large water droplets, and the water film is non-uniform and discontinuous. To determine whether such is detrimental to printing of the cans, they were evaluated for adhesion. That is, the decorated cans were cut open and boiled in a 1% liquid dishwashing detergent solution (Joy ®) comprising 3:1 deionized water:tap water for ten minutes. The cans were then rinsed in deionized water and dried. As in Example I, eight cross-hatched scribe lines were cut into the coating of the cans on the inside and outside sidewalls and the inside dome. The scribe lines were taped over, and then the tape was snapped off. The cans were rated for adhesion values. The average value results are summarized in Table 2.

TABLE 2

| Phosphate ester Solution | Adhesion Rating | | |
|---|---|---|---|
| | OSW | ISW | ID |
| control | 10 | 10 | 10 |
| 1 | 9.8 | 6.8 | 1.0 |
| 2 | 9.8 | 10 | 10 |
| 3 | 10 | 10 | 10 |

In Table 2, OSW stands for outside sidewall, ISW stands for inside sidewall, and ID stands for inside dome.

For the control, it was observed that there was no pick-off (loss of coating adhesion) on either the outside sidewall, the inside sidewall or the inside dome of the cans.

For phosphate ester solution 1, it was observed that there was almost no pick-off on the outside sidewall, substantial pick-off on the inside sidewall, and complete failure on the inside dome of the cans.

For phosphate ester solution 2, it was observed that there was almost no pick-off on the outside sidewall, and no pick-off on the inside sidewall and no pick-off on the inside dome of the cans.

For phosphate ester solution 3, it was observed that there was no pick-off on the outside sidewall, the inside sidewall, and the inside dome of the cans.

EXAMPLE IV

This example illustrates the effect of the lubricant and surface conditioner of this invention on the water draining characteristics of aluminum cans treated therewith.

Aluminum cans were cleaned with acidic cleaner (Ridoline ® 125 CO followed by Alodine ® 404 treatment or Ridoline ® 125 CO only) or with an alkaline cleaner solution (Ridoline ® 3060/306 process), all the products being available from the Parker+Amchem Division, Henkel Corporation, Madison Heights, Mich., and then rinsed with deionized water containing about 0.3% by weight of the lubricant and surface conditioner of this invention. After allowing the thus-rinsed cans to drain for up to 30 seconds, the amount of water remaining on each can was determined. The same test was conducted without the use of the lubricant and surface conditioner. The results are summarized in Table 3.

TABLE 3

| Drain Time (sec) | Water Remaining (g/can) | |
|---|---|---|
| | DI Water | 0.3% Conditioner |
| 6 | 2.4–3.0 | nd |
| 12 | 2.1–3.5 | 2.8 |
| 18 | 2.2–3.5 | 2.3 |
| 30 | 1.8–3.4 | 2.3 |

It was found that the presence of the lubricant and surface conditioner caused the water to drain more uniformly from the cans, and that the cans remain "water-break" free for a longer time.

EXAMPLE V

This example illustrates the effect of the oven dryoff temperature on the sidewall strength of aluminum cans. This test is a quality control compression test which determines the column strength of the cans by measuring the pressure at which they buckle. The results are summarized in Table 4.

TABLE 4

| OVEN TEMPERATURE (°F.) | COLUMN STRENGTH (PSI) |
|---|---|
| 440 | 86.25 |
| 400 | 87.75 |
| 380 | 88.25 |
| 360 | 89.25 |

It can be seen from Table 4 that at an oven drying temperature of 380° F., a 2 psi increase was obtained in the column strength test compared to the value obtained at 440° F. oven temperature.

The higher column strength test results are preferred and required because the thin walls of the finished cans must withstand the pressure exerted from within after they are filled with a carbonated solution. Otherwise, cans having weak sidewalls will swell and deform or may easily rupture or even explode. It was found that the faster water film drainage resulting from the presence therein of the lubricant and surface conditioner composition of this invention makes it possible to lower the temperature of the drying ovens and in turn obtain higher column strength results. More specifically, in order to obtain adequate drying of the rinsed cans, the cans are allowed to drain briefly before entry into the drying ovens. The time that the cans reside in the drying ovens is typically between 2 and 3 minutes, dependent to some extent on the line speed, oven length, and oven temperature. In order to obtain adequate drying of the cans in this time-frame, the oven temperature is typically about 440° F. However, in a series of tests wherein the rinse water contained about 0.3% by weight of a lubricant and surface conditioner of this invention, it was found that satisfactory drying of the cans could be obtained wherein the oven temperature was lowered to 400° F., and then to 370° F., and dry cans were still obtained.

EXAMPLES GROUP VI

Uncleaned aluminum cans from an industrial can manufacturer are washed clean in examples Type A with alkaline cleaner available from Parker+Amchem Division, Henkel Corporation, Madison Heights, Mich., employing the Ridoline ® 3060/306 process and in Examples Type B with an acidic cleaner, Ridoline ® 125 CO from the same company. Following initial rinsing and before final drying, the cleaned cans are treated with a lubricant and surface conditioner comprised of about a 1% by weight active organic (I) in deionized water as specified in Table 5 below. In a separate set of examples, following initial rinsing and before final drying, the cleaned cans are treated with a reactive lubricant and surface conditioner comprised of about a 1% active organic (I) in deionized water plus about 2 gm/l (0.2wt %) of the inorganic (II) as specified in Table 5, below. In yet another set of examples, following initial rinsing and before final drying, the cleaned cans are treated with a lubricant and surface conditioner comprised of about 1% active organic (I) in deionized water plus about 0.5% by weight of surfactant (III) specified in Table 5, below. In a further set of examples, following initial rinsing and before final drying, the cleaned cans are treated with a reactive lubricant and surface conditioner in deionized water comprised of about 1% active organic (I), about 0.2% inorganic (II), about 0.5% surfactant (III) as specified in Table 5, below.

TABLE 5

| Example | Active Organic (I) | | Inorganic | | | Coefficient of static friction |
|---|---|---|---|---|---|---|
| Type | Trade Name | Descripton | (II) | Surfactant (III) | pH | after drying |
| A | Emery 657 | Caprylic acid | $Al_2(SO_4)_3$ | IGEPAL CO-887 | 2.2 | less than 1.5 |
| B | Emery 659 | Capric acid | $H_2ZrF_6$ | TRITON X-101 | 2.2 | less than 1.5 |
| A | Emery 651 | Lauric acid | $FeF_3$ | NEODOL 25-5-3 | 2.3 | less than 1.5 |
| B | Emery 655 | Myristic acid | $SnCl_4$ | TERGITOL TMN-6 | 2.3 | less than 1.5 |
| A | Emersol 143 | Palmitic acid 91% | $Ce(NO_3)_4$ | TRITON DF-16 | 2.6 | less than 1.5 |
| B | Emersol 153 NF | Stearic acid 92% | $H_2TiF_6$ | TRYCOL 6720 | 2.6 | less than 1.5 |
| A | Emersol 871 | Isostearic acid | $H_2HfF_6$ | ANTAROX LF-330 | 2.6 | less than 1.5 |
| B | Emersol 6313 NF | Oleic acid 75% | $(NH_4)_2ZrF_6$ | TRITON H-55 | 2.6 | less than 1.5 |
| A | Empol 1014 | Dimer acid 95% | $Fe_2(SO_4)_3$ | TRITON H-66 | 2.6 | less than 1.5 |
| B | Emery 1110 | Azeleic acid | $Al(NO_3)_3$ | TRITON QS-44 | 2.6 | less than 1.5 |
| B | Ethox MI5 | Ethoxylated isostearic acid | $TiCl_4$ | TRYCOL 6720 | 3.0 | less than 1.5 |
| A | Emulphor VN 430 | Polyoxyethylated oleic acid | $CeI_3$ | SURFONIC LF-17 | 3.0 | less than 1.5 |
| B | Ethox MO5 | Polyoxyethylated oleic acid | $FeF_3$ | LOMAR D | 3.0 | less than 1.5 |
| A | Monamide 150 LW | Lauric alkanolamide | $FeCl_3$ | DOWFAX 2A1 | 2.0 | less than 1.5 |
| B | Monamide 150 MW | Myristic alkanolamide | $FeBr_3$ | DYASULF 9268-A | 3.0 | less than 1.5 |
| A | Monamide 150 IS | Isostearic alkanolamide | $H_2ZrF_6$ | DYASULF C-70 | 4.0 | less than 1.5 |
| B | Monamide 718 | Stearic alkanolamide | $H_2TiF_6$ | IGEPAL CO-887 | 5.0 | less than 1.5 |
| A | Gafac BH 650 | Aliphatic phosphate ester, acid form | $Fe(NO_3)_3$ | POLYTERGENT SLF-18 | 2.0 | less than 1.5 |
| B | Ethox PP16 | Aromatic phosphate ester | $(NH_4)_2ZrF_6$ | PLURONIC L-61 | 3.0 | less than 1.5 |
| A | Gafac BL 750 | Aliphatic phosphate ester, acid form | $TaF_5$ | TETRONIC 701 | 6.0 | less than 1.5 |
| B | Gafac PE510 | Aromatic phosphate ester, acid form | $NbF_5$ | PLURONIC 31R1 | 5.0 | less than 1.5 |
| A | Ethfac 142W | Aliphatic phosphate ester | $H_2ZrF_6$ | PLURONIC 150R1 | 4.0 | less than 1.5 |
| B | Gafac RA 600 | Aliphatic phosphate ester, acid form | $(NH_4)_2MoO_4$ | APG 300 | 6.0 | less than 1.5 |
| A | Armeen Z | N-Coco-B-aminobutyric acid | $H_2TiF_6$ | TRITON CF-21 | 6.0 | less than 1.5 |
| B | Hamposyl L | Lauroyl sarcosine | $VF_4$ | TRITON DF-18 | 5.0 | less than 1.5 |
| A | Hamposyl C | Cocoyl sarcosine | $FeF_3$ | TRITON GR-7M | 4.0 | less than 1.5 |
| B | Hamposyl O | Oleoyl sarcosine | $SnCl_4$ | TRITON H-55 | 3.0 | less than 1.5 |
| A | Hamposyl S | Stearyl sarcosine | $Al_2(SO_4)_3$ | TRITON X-100 | 2.0 | less than 1.5 |
| B | Acusol 410N | Polyacrylic acid, sodium salt, | $H_2ZrF_6$ | TRITON X-120 | 4.0 | less than 1.5 |
| A | Neodol 91-2.5 | $C_9$–$C_{11}$ carbons/ 2.5 ethoxylates | $H_2ZrF_6$ | IGEPAL CO-430 | 6.0 | less than 1.5 |
| B | Neodol 25-12 | $C_{12}$–$C_{15}$ carbons/ 12 ethoxylates | $FeF_3$ | IGEPAL CO-530 | 5.0 | less than 1.5 |
| A | Neodol 45-7 | $C_{14}$–$C_{15}$ carbons/ 7 ethoxylates | $Ce(NO_3)_3$ | IGEPAL CO-710 | 4.0 | less than 1.5 |
| B | Triton GR-5M | Dioctylsulfo-succinate | $Al(NO_3)_3$ | TRYCOL 5882 | 6.0 | less than 1.5 |
| A | Avanel S 70 | Sodium alkylether sulfonate | $VOSO_4$ | TRYCOL 5887 | 5.0 | less than 1.5 |
| B | Igepon TC-42 | Sodium N-coconut and N-methyl taurate | $VF_5$ | TRYCOL 5964 | 4.0 | less than 1.5 |
| A | Igepon TK-32 | Sodium N-methyl-N-tall oil acid | $VF_3$ | IGEPAL CO-887 | 3.0 | less than 1.5 |

TABLE 5-continued

| Example Type | Active Organic (I) Trade Name | Descripton | Inorganic (II) | Surfactant (III) | pH | Coefficient of static friction after drying |
|---|---|---|---|---|---|---|
| | | taurate | | | | |
| B | Neodol 25-3A | Sulfonated linear alcohol, ammonium salt | $(NH_4)_2WO_4$ | IGEPAL CO-630 | 3.0 | less than 1.5 |
| A | Aromox C/12 | Bis(2-hydroxyethyl) cocamine oxide | $(NH_4)_2ZrF_6$ | NEODOL 25-3 | 3.0 | less than 1.5 |
| B | Aromox DMC | Dimethylcocamine oxide | $FeF_3$ | NEODOL 25-35 | 3.0 | less than 1.5 |
| A | Ethoquad 0/25 | Oleyl [POE(15)] ammonium chloride | $Fe_2(SO_4)_3$ | NEODOL 25-9 | 2.0 | less than 1.5 |
| B | Ethoquad C/12 | Cocomethyl [POE(2)] ammonium chloride | $Al_2(SO_4)_3$ | NEODOL 91-25 | 3.0 | less than 1.5 |
| A | Ethoquad 18/5 | Octadecyl [POE(15)] ammonium chloride | $Sn(SO_4)$ | TRITON Q5-15 | 3.0 | less than 1.5 |
| B | Propoquad T/12 | Tallowalkyl-methyl-bis-(2-hydroxy-2-methylethyl) ammonium methyl sulfate | $Ce_2(SO_4)_3$ | TRITON DF-12 | 2.0 | less than 1.5 |
| A | Ethfac 136 | Phosphate ester | $H_2ZrF_6$ | IGEPAL 10-887 | 2.3 | less than 1.5 |
| B | Ethox 2684 | Phosphate ester | $H_2ZrF_6$ | IGEPAL CO-887 | 2.7 | less than 1.5 |
| A | Trylox 5922 | Ethoxylated hydrogenated castor oil | $H_2ZrF_6$ | IGEPAL CO-887 | 2.3 | less than 1.5 |
| B | Trylox 5921 | Ethoxylated hydrogenated castor oil | $H_2TiF_6$ | IGEPAL CO-887 | 2.7 | less than 1.5 |
| A | Trylox 5925 | Ethoxylated hydrogenated castor oil | $H_2ZrF_6$ | TRITON H-66 | 2.7 | less than 1.5 |

Another embodiment of the present invention comprises the application of the technology described herein to providing lubricants and surface conditioners for tin cans especially to aid in dewatering and drying of such cans. The compositions and methods described herein are suitable for that purpose.

The invention claimed is:

1. A process comprising the steps of cleaning an aluminum can with an aqueous acidic or alkaline cleaning solution, drying the cleaned can, and subsequently conveying the cleaned and dried can via automatic conveying equipment to a location where it is lacquered or decorated by printing or both, wherein the improvement comprises contacting at least one exterior surface of said aluminum can, prior to the last drying of said exterior surface before automatic conveying, with a reactive lubricant and surface conditioner composition, thereby forming a film on the can surface to provide the surface of the can after drying with a coefficient of static friction that is not more than 1.5 and that is less than would be obtained on a can surface of the same type without such film coating, said reactive lubricant and surface conditioner composition being an aqueous solution comprising water-soluble organic material selected from phosphate esters, alcohols, fatty acids including mono-, di-, tri-, and poly-acids; fatty acid derivates including salts, hydroxy acids, amides, esters, ethers, and derivatives thereof, and mixtures thereof, and at least one of the elements selected from zirconium, titanium, cerium, aluminum, iron, tin, vanadium, tantalum, niobium, molybdenum, tungsten, and hafnium in metallic or ionic form and the film formed on the can surface contains at least part of said inorganic material in addition to said organic material.

2. A process according to claim 1, wherein said aqueous solution includes sulfate or sulfonate salts.

3. A process according to claim 1, wherein said aqueous solution comprises at least one material selected from the group consisting of alkoxylated and non-alkoxylated amine salts of a fatty acid including mono-, di-, tri-, and poly-acids; alkoxylated and non-alkoxylated amino fatty acids, alkoxylated and non-alkoxylated fatty amine N-oxides, alkoxylated and non-alkoxylated quaternary ammonium salts, and water-soluble alkoxylated and non-alkoxylated polymers.

4. A process according to claim 3, wherein said aqueous solution includes at least one material selected from the group consisting of alkoxylated amine salts of a fatty acid including mono-, di-, tri-, and poly-acids; alkoxylated amino fatty acids, alkoxylated fatty amine N-oxides, alkoxylated quaternary ammonium salts, and water-soluble alkoxylated polymers.

5. A process according to claim 4, wherein said aqueous solution includes at least one material selected from the group consisting of ethoxylated amine salts of a fatty acid including mono-, di-, tri-, and poly-acids; ethoxylated amino fatty acids, ethoxylated fatty amine N-oxides, ethoxylated quaternary ammonium salts, and water-soluble ethoxylated polymers.

6. A process according to claim 3 wherein said aqueous solution includes an amine salt of a fatty acid.

7. A process according to claim 3 wherein said aqueous solution includes an amino fatty acid.

8. A process according to claim 3 wherein said aqueous solution includes a fatty amine N-oxide.

9. A process according to claim 3 wherein said aqueous solution includes a quaternary salt.

10. A process according to claim 3 wherein said aqueous solution includes a water soluble polymer.

11. A process according to claim 1 wherein said aqueous solution includes an alkoxylated or non-alkoxylated castor oil triglyceride or a hydrogenated castor oil derivative.

12. A process according to claim 1 wherein said inorganic material includes zirconium.

13. A process according to claim 1 wherein said inorganic material includes titanium.

14. A process according to claim 1 wherein said aqueous solution also includes a non-ionic, anionic, cationic, or amphoteric surfactant.

15. A process according to claim 14 wherein said surfactant is ethoxylated.

16. A process according to claim 14 wherein said surfactant is an anionic surfactant.

17. A process according to claim 1 wherein said lubricant and surface conditioner is applied following can cleaning.

* * * * *